United States Patent [19]

Walter

[11] 4,187,022

[45] Feb. 5, 1980

[54] APPARATUS FOR TRANSPORTING WEBS OF PHOTOSENSITIVE MATERIAL

[75] Inventor: Karl Walter, Penzberg, Fed. Rep. of Germany

[73] Assignee: Labortechnik M. R. Walter, Penzberg, Fed. Rep. of Germany

[21] Appl. No.: 9,513

[22] Filed: Feb. 5, 1979

[30] Foreign Application Priority Data

Feb. 3, 1978 [DE] Fed. Rep. of Germany ..... 2804724

[51] Int. Cl.[2] ..... G03D 5/06

[52] U.S. Cl. ..... 354/318; 354/319; 354/324; 134/122 P; 226/108; 226/168; 242/55

[58] Field of Search ..... 354/312, 313, 314, 316, 354/318, 319, 320, 321, 322, 329, 330; 134/64 P, 122 P, 14; 226/108, 119, 168; 242/55, 55.01

[56] References Cited

U.S. PATENT DOCUMENTS

| | | | |
|---|---|---|---|
| 2,191,850 | 2/1940 | Debrie | 354/321 |
| 3,662,665 | 5/1972 | Meeussen et al. | 134/64 P |
| 3,885,748 | 5/1975 | Costello et al. | 354/55 |
| 3,968,510 | 7/1976 | Allen | 354/319 |
| 4,003,070 | 1/1977 | Merz et al. | 354/322 |
| 4,025,937 | 5/1977 | Lowry et al. | 354/321 X |

*Primary Examiner*—George H. Miller, Jr.
*Assistant Examiner*—Alan Mathews
*Attorney, Agent, or Firm*—Peter K. Kontler

[57] ABSTRACT

Apparatus for transporting exposed films or webs of photographic paper along a helical path through a vessel in a developing machine has a set of parallel rings mounted between and rotated by three shafts which are parallel to the axis of the helical path. The planes of the rings make acute angles with the axis of the helical path, and each ring is rotated about its own axis. The leader of a web which is fed into the space within the rings is engaged by the inner surfaces of successive rings and is transported along the helical path. During transport along such path, the web travels around a stationary or rotating twin-walled foraminous pipe which discharges a pressurized fluid whereby the fluid impinges against the emulsion-coated inner side of the web and urges the web against the inner surfaces of the rings so that the pressure of fluid assists the centrifugal force and cohesion between the web and the rings to maintain the web in the helical path. The shafts have circumferential grooves for portions of the rings, and one of the shafts is movable axially to change the inclination of the rings.

13 Claims, 3 Drawing Figures

APPARATUS FOR TRANSPORTING WEBS OF PHOTOSENSITIVE MATERIAL

BACKGROUND OF THE INVENTION

The present invention relates to apparatus for processing webs of photosensitive material, and more particularly to improvements in apparatus for transporting exposed photographic films or the like through one or more processing stations, e.g., through one or more vessels or tanks of a developing machine.

Webs of photosensitive material which must be transported through successive tanks and other units of a developing machine are normally clamped or spliced to each other, end-to-end, to form a long strip which is conveyed through the machine by pairs of advancing rolls engaging the opposite sides of the strip. If the web consists of photographic paper, its leader is normally attached to a threading tape which pulls the web through successive stations of the machine. Each liquid-containing tank of a developing machine further comprises a number of guide rolls defining a meandering path along which the web consisting of several customer films or of a roll of photographic paper is transported so as to insure that each and every portion of the web will dwell in the corresponding tank for a required interval of time. A drawback of such developing machines is that each tank must contain a substantial quantity of liquid which must be circulated, maintained at a predetermined temperature and regenerated at a substantial cost. Furthermore, the splicing of films end-to-end and/or the attachment of webs of photographic paper to threading tapes is a time-consuming operation and/or necessitates additional expenditures for complex and expensive auxiliary equipment.

OBJECTS AND SUMMARY OF THE INVENTION

An object of the invention is to provide a novel and improved apparatus which can predictably transport relatively wide, narrow, short or long webs of photosensitive material along a selected path without resort to splicing, clamping, utilization of threading tapes and/or substantial amounts of processing fluids.

Another object of the invention is to provide the apparatus with novel and improved means which insures that the conveyed web or webs are intimately and uniformly contacted by one or more processing fluids in a small area and by resorting to small quantities of such liquids.

A further object of the invention is to provide the apparatus with novel and improved means for adjusting the speed of transported webs, either as a function of the width of webs or in dependency on other parameters.

An additional object of the invention is to provide the apparatus with novel and improved means for preventing contact between solid components and the emulsion at one side of a film, photographic paper or other web-like photosensitive material.

An ancillary object of the invention is to provide an apparatus which can be installed in existing developing, drying and similar machines as a superior substitute for heretofore known web transporting apparatus.

Another object of the invention is to provide an apparatus which renders it possible to introduce the leader of a web into the desired path without resorting to threading tapes or the like, e.g., to introduce the leader of a convoluted web of photographic film or photographic paper directly into the first tank of a developing machine in a photographic processing laboratory for customer films or the like.

The invention is embodied in an apparatus for transporting webs of photosensitive material along a helical path, e.g., a helical path whose axis is horizontal or substantially horizontal. The apparatus comprises a plurality of parallel substantially ring-shaped advancing elements disposed in planes making acute angles with the axis of the helical path and having inner surfaces adjacent to the path, and means for rotating the ring-shaped elements about their respective axes in a predetermined direction so that a web whose leader is introduced into the path is engaged and entrained by the inner surfaces of the advancing elements. The web remains in contact with the inner surfaces under the action of centrifugal force and as a result of cohesion between its preferably uncoated external surface and the inner surfaces of the advancing elements.

The apparatus further comprises means for discharging a pressurized gaseous or hydraulic fluid substantially radially outwardly against the web in the helical path so that the discharged fluid urges the web against the inner surfaces of the advancing elements. The discharging means may comprise a stationary or rotating foraminous pipe whose axis coincides or nearly coincides with the axis of the helical path and whose external surface is preferably closely adjacent to but out of contact with the emulsion-coated inner side of the web which advances along the helical path. The advancing elements may be mounted in a vessel (e.g., in one of the tanks in a developing machine for photographic films or photographic paper) which collects the fluid that is discharged against the web in the helical path. The fluid issues through the annular clearances between the neighboring advancing elements.

The inclination of the planes of advancing elements with respect to the axis of the helical path can be adjusted by the means which rotates the advancing elements. To this end, the rotating means may comprise two driven shafts which are outwardly adjacent to and engage the advancing elements at a level below the axis of the helical path and an axially reciprocable shaft which is outwardly adjacent to and engages the advancing elements at a level above the axis of the helical path. Such adjustment is desirable in order to enable the apparatus to transport webs of different widths. The peripheral speed of the advancing elements is preferably varied as a function of changes in the inclination of their planes with respect to the axis of the helical path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
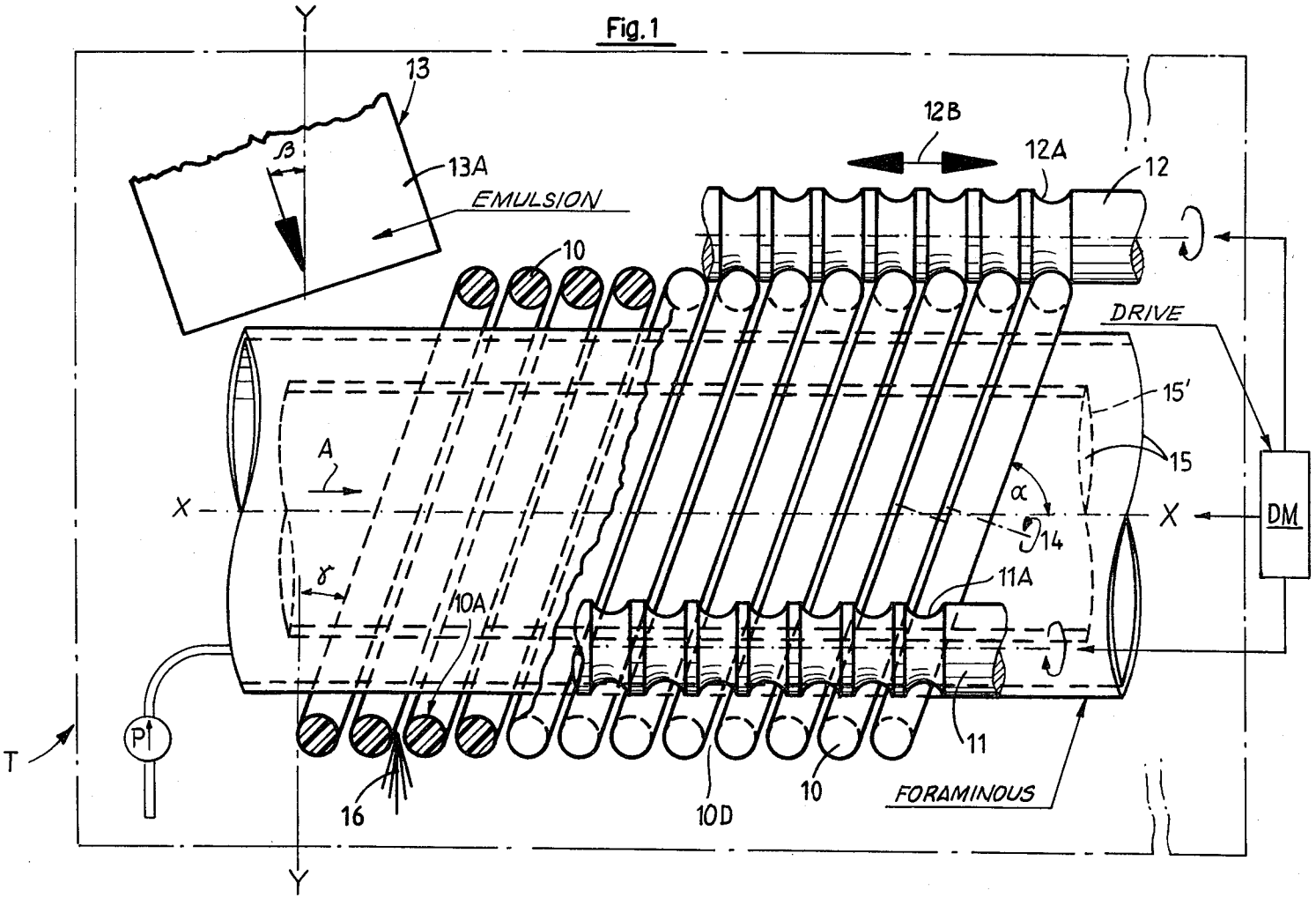
FIG. 1 is a fragmentary partly elevational and partly sectional view of an apparatus which embodies one form of the invention.
Figure 2:
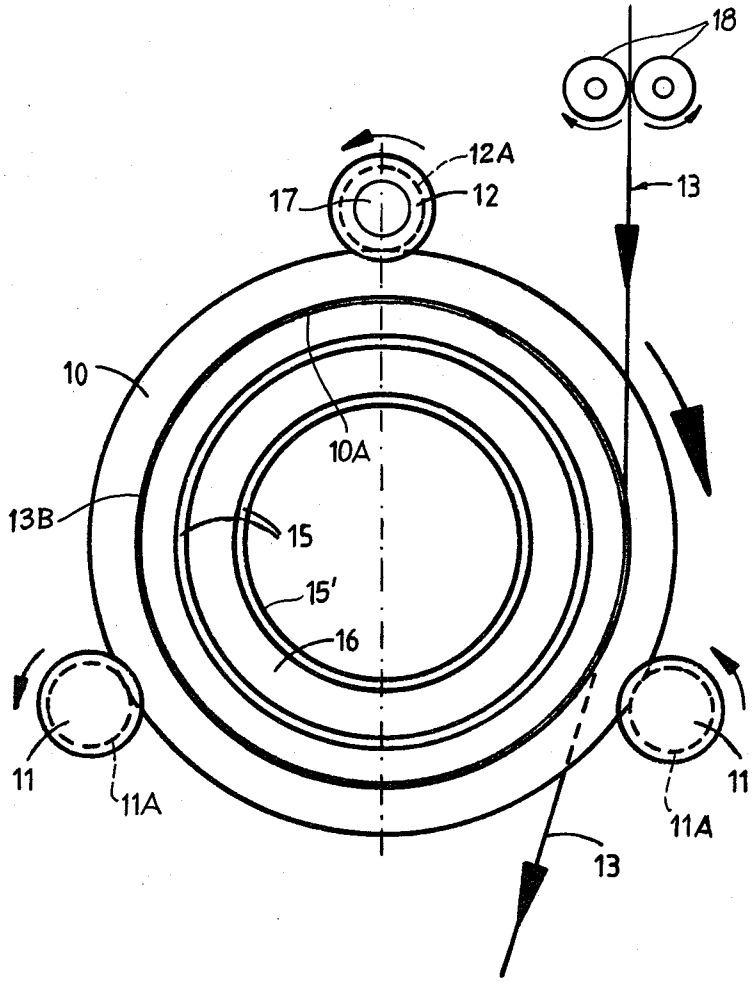
FIG. 2 is an end elevational view of the apparatus which is shown in FIG. 1.

Referring to FIGS. 1 and 2, there is shown an apparatus which is designed to transport webs 13 having a width of 60 mm. The apparatus comprises a set or group of ring-shaped advancing elements 10 (hereinafter called rings) which preferably consist of a suitable synthetic plastic material and are disposed in parallel planes each making an acute angle alpha with the axis X—X of a helical path for the web 13. The means for rotating and supporting the rings 10 comprises three parallel shafts including two shafts 11 which are driven to rotate in a counterclockwise direction, as viewed in FIG. 2 and are located at a level below the axis X—X, and a third shaft 12 which is also driven to rotate counterclockwise whereby the rings 10 rotate clockwise, as viewed in FIG. 2. The shaft 12 is located at a level above the axis X—X. The rings 10 have circular cross-sectional outlines and portions of each ring are guided in corresponding circumferential annular grooves 11A, 12A of the respective shafts. The shaft 12 is movable axially in the directions indicated by double-headed arrow 12B to thereby change the inclination of the entire group of rings 10 depending on the width of the web 13. The inclination which is shown in FIG. 1 is suitable for transport of a web 13 having the width of 60 mm. The number of rings 10 depends on the desired output of the apparatus.

The rings 10 which are shown in FIG. 1 are installed in a vessel or tank T, e.g., a tank which collects a developing solution. A second tank, not shown, adjacent to the tank T can contain a second set of rings which transport successive webs 13 through a fixing solution. Such second tank can be followed by a third tank for interception of a rinsing liquid, and a further set of rings can be installed in a drying unit which reduces the moisture content of exposed and developed webs 13.

The web 13 which is introduced into the interior of the illustrated set of rings 10 adheres to the inner surfaces 10A of the rings by centrifugal force, as a result of cohesion between its external surface and the inner surfaces 10A, and owing to the pressure of processing fluid which is sprayed onto the emulsion-coated inner side of the web. The web advances in a direction from the left to the right, as viewed in FIG. 1. The inner surfaces 10A of the rings 10 automatically advance the helically convoluted web in the desired direction (arrow A in FIG. 1). The number of rings 10 in each tank need not be identical; such number depends on the desired interval during which each increment of the emulsion-coated inner side of the web 13 is maintained in contact with a particular fluid. The angle beta at which the web 13 is introduced into the interior of the illustrated set of rings 10 is complementary to the angle alpha and is disposed at the opposite side of a plane Y—Y which is normal to the axes of the shafts 11 and 12. Such mode of introducing the web 13 insures that the latter is conveyed by the rings 10 in the direction of arrow A, i.e., the outer sides of successive unit lengths of the web 13 engage the inner surfaces 10A of successive discrete rings or smaller sets of rings, depending on the width of the web and on the dimensions of and spacing between neighboring rings of the group. The positions of the shafts 11 and 12 are such that the rings 10 rotate about their successive axes 14.

The means for admitting a processing fluid comprises a foraminous pipe 15 which is stationary or rotates about its own axis which is parallel to the axes of the shafts 11 and 12. It is desirable to employ a relatively large pipe whose outer diameter is only slightly less than the inner diameter of the helical path along which the web 13 advances. The advancing web does not contact the external surface of the pipe. Liquid 16 which issues from the holes, perforations or pores in the outer wall of the pipe 15 can escape through the annular clearances 10D between neighboring rings 10 to accumulate in the tank T. The manner in which the liquid is pressurized to form sprays or jets which impinge upon the emulsion-coated inner side of the helically convoluted web 13 forms no part of the invention. Such liquid can be pressurized by a pump P which draws the liquid from the tank T. If the fluid in the pipe 15 is a gaseous medium (e.g., hot air), such fluid effects rapid reduction of the moisture content of the advancing web because it impinges upon the inner side and thereupon also the outer side of the web during escape through the clearances 10D. It is clear, however, that the drying action can be promoted by installing one or more nozzles adjacent to the external surface of the web which travels through the set of rings 10.

The reference character DM denotes a drive which transmits torque to the shafts 11, 12 and (if necessary) to the pipe 15. The drive DM is preferably designed in such a way that the peripheral speed of rings 10 changes as a function of changes in the inclination of planes of the rings. In other words, the speed at which the rings 10 rotate is changed when the shaft 12 is moved axially, e.g., by the piston rod of a double-acting cylinder and piston unit 17. The piston rod may but need not rotate with the shaft 12.

The reference character 15' denotes the inner wall of the pipe 15. The fluid which is supplied by the pump P enters the annular space between the inner and outer walls of the twin-walled pipe 15.

FIG. 2 shows the leader 13A of the web 13 and the convolutions 13B which advance along the helical path adjacent to the inner surfaces 10A of the rings 10.

When the apparatus is assembled, the shafts 11 are journalled in the tank T before the shaft 12, and the rings 10 are placed onto and rest on the shafts 11. The shaft 12 is thereupon moved to the illustrated position and its axial position is selected by the unit 17 so as to correspond to the width of the web 13. The shafts 11 and 12 are preferably equidistant from each other (see FIG. 2). FIG. 2 further shows two driven rolls 18 which feed the web into the helical path within the set of rings 10.

As stated above, the angle beta is complementary to the angle alpha, i.e., the sum of these angles is 90 degrees. The angle beta equals the angle gamma which the planes of the rings 10 make with the plane Y—Y. This plane is normal to the axis X—X. Thus, the angle at which the rollers 18 feed the web 13 into the helical path is mirror symmetrical to the angle gamma with reference to the plane Y—Y. The angle beta is changed when the angles alpha and gamma are changed, i.e., when the shaft 12 is moved axially to change the inclination of the planes of rings 10 preparatory to admission of a narrower or wider web. The minimum length of a web which can be transported by the improved apparatus slightly exceeds the length of an inner surface 10A, as considered in the circumferential direction of the respective ring 10. The inclination and peripheral speed of the rings 10 are selected in such a way that the inclination is increased and the peripheral speed is reduced when a narrower web is followed by a wider web, and vice versa. Thus, the output of the apparatus increases when the apparatus advances and processes relatively narrow webs. Therefore, the apparatus can be used with advantage for the processing of relatively narrow films.

An important advantage of the improved apparatus is that the dimensions of the tank T can be reduced and that the quantity of processing fluid is a fraction of that which is needed in conventional developing machines. This results in savings in space and reduces the cost of processing. Moreover, the quantity of chemicals that are needed to process a web is small which is highly desirable when the nature of chemicals is such that they must be used in minimal quantities due to high cost or for ecological reasons. The spraying of liquid against the inner side of a web in the helical path by way of pores or holes in the outer wall of a pipe which is immediately or closely adjacent to the helical path is much more economical than the conveying of webs through a liquid bath.

The maximum outer diameter of the pipe 15 depends on the extent to which the rings 10 can be tilted by the shaft 12. Thus, a web in the helical path should not contact the pipe 15 even if the rings 10 are held in positions of maximum inclination with respect to the plane Y—Y, i.e., when the apparatus processes webs of maximum width.

The utilization of a twin-walled pipe 15 is desirable in order to achieve additional savings in liquid. Moreover, such apparatus can employ a relatively small pump whose output suffices to maintain the liquid in the pipe 15 under requisite pressure. Spraying of liquid which issues from the pores or holes in the outer wall of the pipe 15 results in uniform treatment of each unit area of emulsion at the inner side of the web which advances along the helical path. The liquid is agitated in the region adjacent to the inner side of the web in the interior of rings. Spent liquid escapes by centrifugal force by flowing through the clearances 10D and into the tank T.

As mentioned above, the improved apparatus can be used for treatment of webs with a gaseous fluid, e.g., hot air. Such gaseous fluid can be employed to expel moisture from a web which has issued from a wet-treatment station. Since the helical convolutions 13B are temporarily separated from the advancing means during travel from a preceding ring 10 toward the inner surface 10A of the next following ring, the gaseous fluid which surrounds the rings can expel moisture from the inner and outer sides of the moving web.

Figure 3:
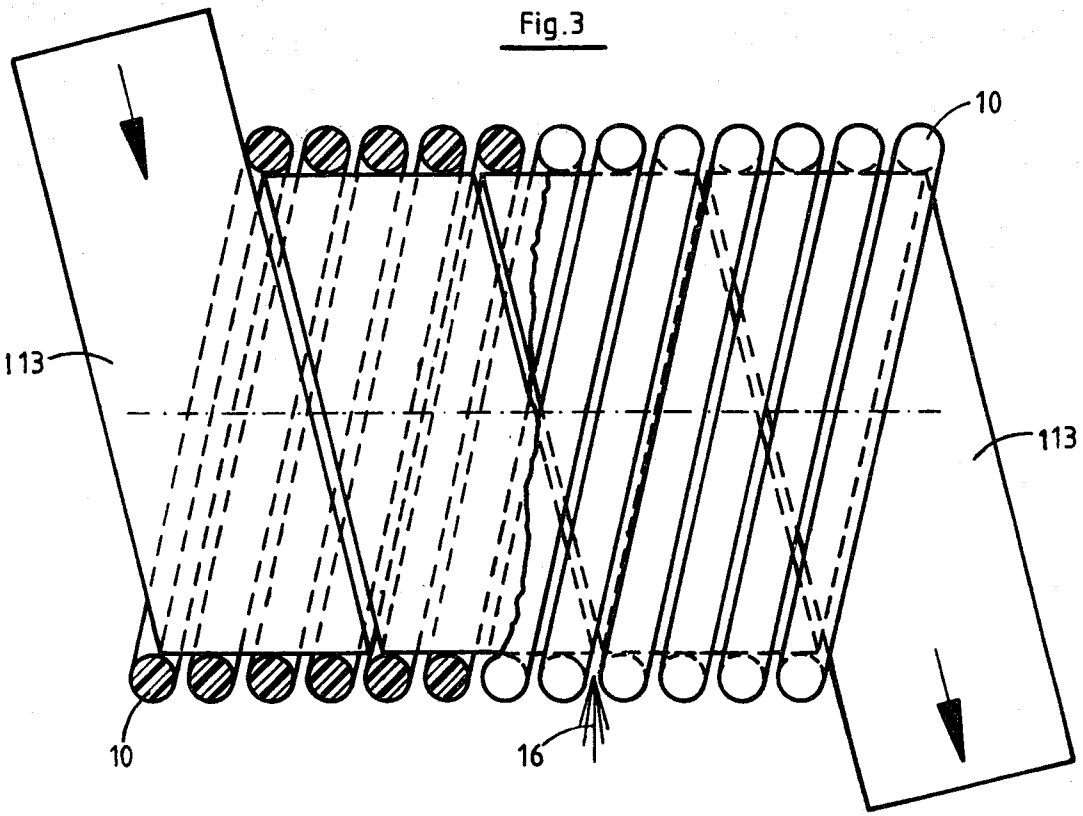
FIG. 3 is a fragmentary partly elevational and partly sectional view of a modified apparatus.

FIG. 3 shows a portion of an apparatus wherein the inclination of rings 10 with respect to the axes of the shafts (not shown) is such that the rings can properly transport a web 113 having a width of 35 mm. The manner in which the pipe is installed in the set of rings 10 of FIG. 3 is the same as shown in FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the claims.

What is claimed is:

1. Apparatus for transporting webs of photosensitive material along a helical path, comprising a plurality of parallel ring-shaped advancing elements disposed in planes making acute angles with the axis of said path and having inner surfaces adjacent to said path; and means for rotating said elements about their respective axes in a predetermined direction so that a web whose leader is introduced into said path is engaged and entrained by said inner surfaces.

2. Apparatus as defined in claim 1, further comprising means for discharging a pressurized fluid substantially radially outwardly against the web in said path so that the discharged fluid urges the web against said inner surfaces.

3. Apparatus as defined in claim 2, further comprising a vessel for said advancing elements, said vessel being arranged to collect the fluid which is discharged against the web in said path.

4. Apparatus as defined in claim 1, further comprising means for adjusting the inclination of the planes of said advancing elements with respect to the axis of said helical path.

5. Apparatus as defined in claim 4, wherein said adjusting means forms part of said rotating means.

6. Apparatus as defined in claim 4, wherein said rotating means includes means for varying the peripheral speed of said advancing elements as a function of changes of said angle.

7. Apparatus as defined in claim 1, further comprising a foraminous tubular member extending into said advancing elements and surrounded by said path, and means for admitting into said member a pressurized fluid which is discharged by said foraminous member against the web in said path to urge the web against said inner surfaces.

8. Apparatus as defined in claim 7, further comprising means for rotating said foraminous member about the axis of said path.

9. Apparatus as defined in claim 1 for transporting webs of the type having an emulsion-coated side and an uncoated side, said uncoated sides being in contact with said inner surfaces during transport of webs along said helical path.

10. Apparatus as defined in claim 9, further comprising twin-walled tubular means for spraying a fluid against the emulsion-coated side of the web in said path, said advancing elements being separated from each other by annular clearances through which the sprayed fluid is free to escape radially outwardly from said helical path.

11. Apparatus as defined in claim 1, wherein the axis of said path is substantially horizontal and said rotating means comprises a pair of driven shafts outwardly adjacent to and engaging said advancing elements at a level below said axis and a further driven shaft outwardly adjacent to and engaging said elements at a level above the axis of said path.

12. Apparatus as defined in claim 11, wherein said shafts are parallel to the axis of said path and have circumferential grooves for portions of said elements.

13. Apparatus as defined in claim 11, wherein said elements consist of synthetic plastic material.

* * * * *